US006805409B2

(12) United States Patent
Parker

(10) Patent No.: US 6,805,409 B2
(45) Date of Patent: Oct. 19, 2004

(54) ARTICULATED BENCH

(76) Inventor: James Parker, 106 Shelbourne Dr., York, PA (US) 17403

( * ) Notice: Subject to any disclaimer, the term of this patent is extended or adjusted under 35 U.S.C. 154(b) by 0 days.

(21) Appl. No.: 10/341,330

(22) Filed: Jan. 10, 2003

(65) Prior Publication Data

US 2004/0135416 A1 Jul. 15, 2004

Related U.S. Application Data

(60) Provisional application No. 60/348,081, filed on Jan. 9, 2002.

(51) Int. Cl.[7] ..... B60N 2/02; A47B 3/00; A47C 31/00; A63B 26/00

(52) U.S. Cl. ..... 297/377; 297/316; 297/158.4; 297/159.1; 297/183.1; 482/142

(58) Field of Search ..... 297/377, 316, 297/158.4, 159.1, 183.1; 482/142

(56) References Cited

U.S. PATENT DOCUMENTS

| | | | | | |
|---|---|---|---|---|---|
| 2,208,945 | A | * | 7/1940 | Miller | 297/170 |
| 3,342,485 | A | * | 9/1967 | Gaul | 482/145 |
| 4,423,865 | A | * | 1/1984 | Mahnke | 482/104 |
| 4,635,934 | A | * | 1/1987 | Roethke | 482/104 |
| 4,653,751 | A | * | 3/1987 | Green | 482/104 |
| 4,960,277 | A | * | 10/1990 | LaRossa et al. | 482/104 |
| 5,232,426 | A | * | 8/1993 | Van Straaten | 482/123 |
| 5,350,346 | A | * | 9/1994 | Martinez | 482/142 |
| 5,649,886 | A | * | 7/1997 | Danylieko | 482/142 |
| 5,882,283 | A | * | 3/1999 | Stevens | 482/104 |
| 5,993,360 | A | * | 11/1999 | Stevens | 482/104 |
| 6,245,001 | B1 | * | 6/2001 | Siaperas | 482/142 |
| 6,287,243 | B1 | * | 9/2001 | Isom et al. | 482/142 |

* cited by examiner

*Primary Examiner*—Peter M. Cuomo
*Assistant Examiner*—Sarah C. Burnham
(74) *Attorney, Agent, or Firm*—Law Offices of Royal W. Craig

(57) ABSTRACT

An articulated bench comprising a two-section pad attached to a rectangular frame and two folding/pivoting support leg assemblies. The two padded sections are pivotally attached to the frame. Either of the two padded end sections can be pivoted upward and locked at a selectable incline. Either of a length-adjustable I-shaped brace assembly, or alternatively, a U-shaped support assembly fold out of the frame from beneath the longer of the two pivoting, padded end sections (i.e. the section for supporting the upper body) and are inserted into one of a series of catches located on the section's rear surface to hold it at a selectable incline. The shorter of the two pivoting, padded end sections (i.e. the section for supporting an individual's lower body) also pivots upward and a U-shaped support assembly folds out of the frame and is inserted in a pair of surface-mounted catches to maintain the section in an inclined position. The present invention's design is simple and straightforward, and can be economically manufactured and can quickly and easily be set up, or knocked down and carried.

8 Claims, 7 Drawing Sheets

ARTICULATED BENCH

CROSS-REFERENCE TO RELATED INVENTION(S)

The present application drives priority from U.S. Provisional Patent Application No. 60/348,081 filed Jan. 9, 2002.

BACKGROUND OF THE INVENTION

1. Field of the Invention

The present invention relates to support benches such as utilized during body toning, weight training, and other therapeutic activities and, more particularly, to a portable, fully-articulated, multi-purpose bench.

2. Description of the Background

Many different activities such as body toning, weight training, weight-lifting, and other therapeutic and/or athletic activities require the use of a supporting structure capable of supporting the body in a variety of positions. For example, for an effective workout a weight lifter must exercise all major muscle groups by placing themself in a variety of positions ranging from flat-on-their-stomach, to reclining, to flat-on-their back, and all at a height that provides a full range of arm or leg motion. Similarly, many body toning exercises, aerobic programs, rehabilitative, and like therapeutic activities require the participant to position himself/herself in a variety of seated or lying positions at various angles.

The present inventor is not the first to address the issue of supporting the body during therapy or exercise. A massage-related apparatus is found in U.S. Pat. No. 5,913,271 to Lloyd which discloses a collapsible massage table that has two sides. Each side is supported by a support structure that includes two legs. Various cable lines are used to stabilize the legs when the table is open and upright. The cables also function to automate or semi-automate leg, brace and truss extension and/or folding during opening and collapsing processes.

Additionally, there are other apparatus, primarily associated with weightlifting exercises, designed to support the body in a variety of positions. One variation on this theme is found in U.S. Pat. No. 4,765,616 to Wolff which discloses a workout bench for exercising that includes weightlifting and other bench oriented exercises. A barbell rack is positioned at one end and a laterally extending frame member provides support for a two section bench. The two sections of the bench are mounted on a slider that slides along the length of the laterally extending frame member and can be adjusted and held in any desired position along this length. The bench sections are hinged so that they will both incline, and the position of the hinge is controlled by the slider so that the amount of inclination of the bench back section, which rests against supports on the rack at one end can be changed by sliding the slider to a desired location. The shorter seat bench section can be inclined through the use of a separate support member that will incline the bench at a particular angle and which will move with the slider. The hinge for the bench can be adjusted in position relative to the rack so that barbells supported on the rack can be lifted properly.

A second weightlifting-related apparatus is found in U.S. Pat. No. 4,645,196 to Christie. That patent discloses a weightlifter's bench which can be folded into a compact form suitable for storage. The folding feature is provided by a frame made of two facing U-shaped members which can be engaged by bolts which slide within the frame. Two support panels positioned upon the frame are hinged together to facilitate folding and also to permit one panel to be inclined for special exercises. The frame is supported by four legs which pivot about the frame for storage and can be locked into position by brackets pivoted to the legs and adapted to be secured to the underside of the frame. Support posts are provided for a barbell, and leg exercising means may be provided.

Yet another is found in U.S. Pat. No. 4,960,277 to LaRossa et al. which discloses a light-weight foldable weightlifter's bench. The bench is equipped with adjustable barbell receivers and a positionable back support. A fold up frame supporting a top bench pad can be quickly folded to nearly a flat position for storage such as under a bed. The invention is structured in the form of a foldable frame which supports an attached padded panel in the manner of a slant board. The padded panel is transversely hinged centrally so a back rest section can be raised and lowered according to the requirements of the user. The foldable frame when opened for use has a horizontally positioned generally rectangular pad support frame, simply called a pad frame, which is supported at each end by vertically positioned leg frames.

Unfortunately, each of these prior art devices possesses a design specific to use either for massage or weightlifting purposes. The massage table of Lloyd, while collapsible, does not provide the upper/lower body support in an inclined position required by weightlifting or other exercise programs. The utility of the Wolff, Christie, and LaRossa et al. devices for non-weightlifting purposes is compromised by the presence of barbell support posts. These vertically extending posts limit access, for example, by a therapist, to an individual lying prone on the surface located there between, and establish a size (i.e. width) restriction for persons intending to use the associated device. In light of the shortcomings of prior art exercise benches, it is desirable to have a relatively simple adjustable exercise bench which can be placed in a horizontal position and which also can provide multiple back rest angles and multiple seat rest angles for supporting the body in a variety of non-vertical positions. An apparatus of this type should also be easily and quickly collapsible to allow for easy storage, lightweight for optimum portability, and economical to manufacture in order to provide for widespread use. It is further desirable to provide a light-weight portable folding bench with extremely sturdy adjustment mechanisms for all of the back rest, seat rest, and legs, so as to lock each into a full spectrum of positions ranging from 90 degrees seated, to lying horizontal, to being folded and stored. The present invention overcomes the disadvantages of the prior art, while providing the above mentioned desirable features of a multi-adjustable multi-purpose bench.

SUMMARY OF THE INVENTION

It is, therefore, an object of the present invention to provide an improved apparatus for supporting the body in a variety of non-vertical positions for a variety of activities, including body toning, weight training, weight-lifting, and other therapeutic activities.

It is another object of the present invention to provide an improved apparatus for non-vertical support of the body that may be adjusted to a variety of inclined positions.

Yet another object of the present invention is to provide an improved apparatus for non-vertical support of the body that supports the upper and/or lower sections of the body in a variety of inclined positions.

It is still another object of the present invention to provide an improved apparatus for non-vertical support of the body in the above-described manner that is quickly and easily collapsible, lightweight and portable.

It is another object of the present invention to provide lightweight portable bench with sturdy locking joints to reduce the propensity for accidents.

These and other objects are accomplished by an articulated bench that generally comprises a two-section pad attached to a rectangular frame and two folding/pivoting support leg assemblies. The two padded sections are pivotally attached to the frame. Either of the two padded end sections can be pivoted upward and locked at a selectable incline. Either of a length-adjustable I-shaped brace assembly, or alternatively, a U-shaped support assembly fold out of the frame from beneath the longer of the two pivoting, padded end sections (i.e. the section for supporting the upper body) and are inserted into one of a series of catches located on the section's rear surface to hold it at a selectable incline. The shorter of the two pivoting, padded end sections (i.e. the section for supporting an individual's lower body) also pivots upward and a U-shaped support assembly folds out of the frame and is inserted in a pair of surface-mounted catches to maintain the section in an inclined position.

A support leg assembly is pivotally mounted at each end of the rectangular frame. The support leg assemblies fold inward for storing or transporting the bench. Upon folding outward, a locking folding brace holds the legs in position substantially perpendicular to the frame. The support leg assemblies pivot about axles that are common to the U-shaped support assemblies, and the common axes increase'stability and reduce manufacturing costs.

The articulated bench of the present invention is fabricated of a variety of strong, light-weight materials to provide the durability and portability required by the nature of its usage. The present invention's design is simple and straightforward, and can be economically manufactured.

BRIEF DESCRIPTION OF THE DRAWINGS

Other objects, features, and advantages of the present invention will become more apparent from the following detailed description of the preferred embodiments and certain modifications thereof when taken together with the accompanying drawings in which.

DETAILED DESCRIPTION OF THE PREFERRED EMBODIMENTS

Figure 1:
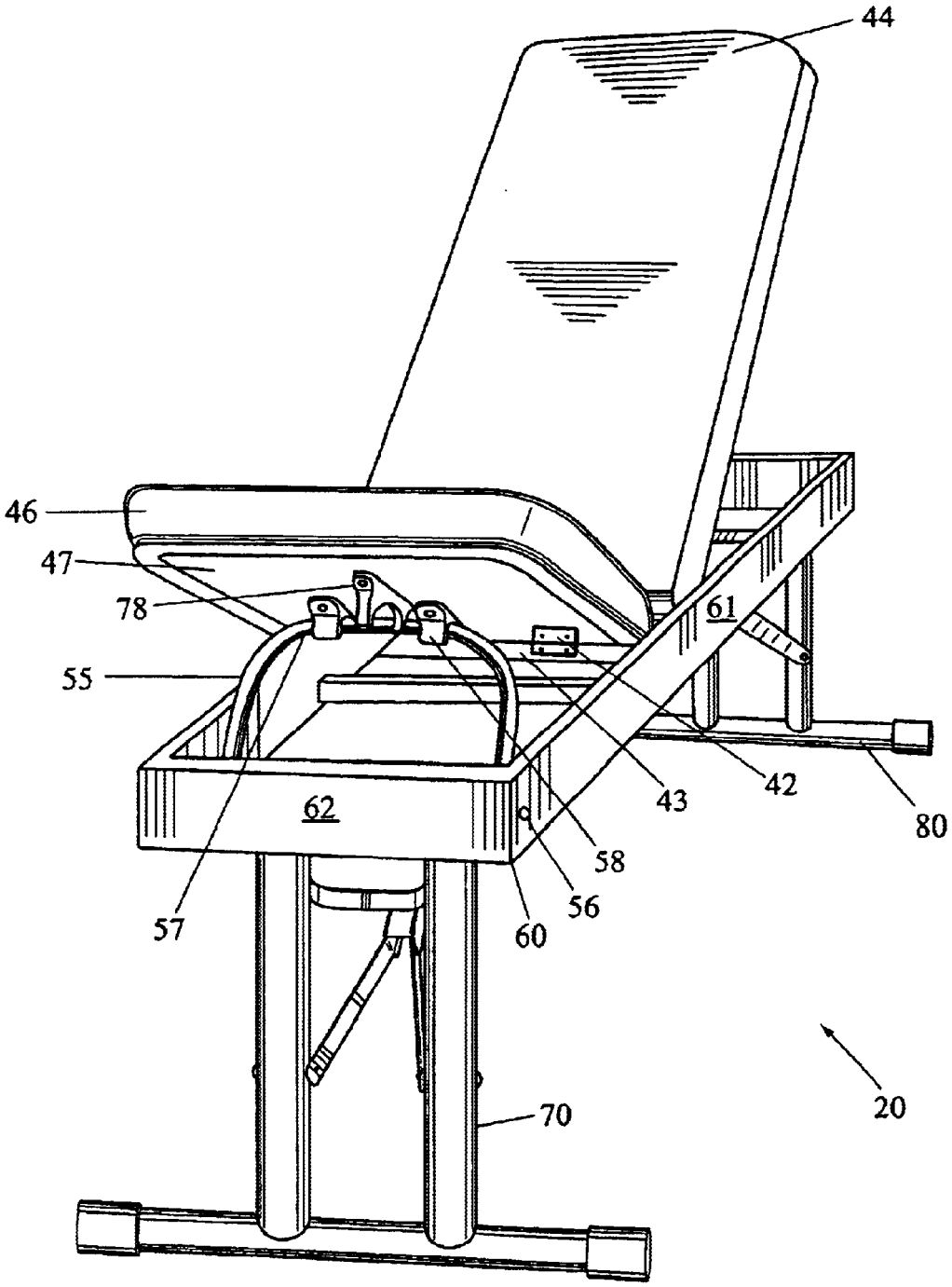
FIG. 1 is a front perspective view of an articulated bench 20 according to a first embodiment of the present invention.
Figure 2:
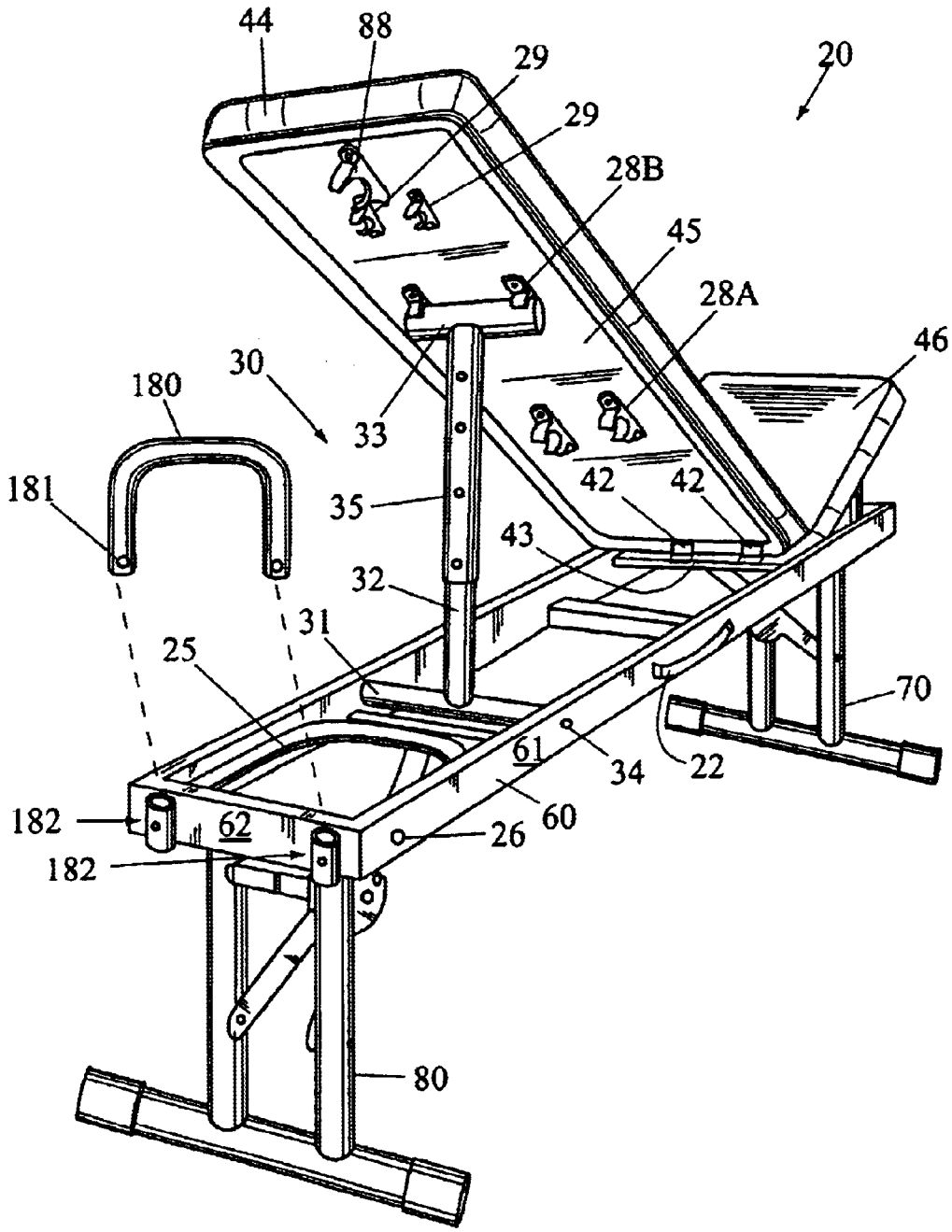
FIG. 2 is a rear perspective view of the articulated bench 20 as in FIG. 1.

FIGS. 1–2 are, respectively, front and rear perspective views of an articulated bench 20 according to a first embodiment of the present invention.

The articulated bench 20 according to the present invention generally comprises a two-section supporting surface comprising two articulated padded sections 44, 46 that are pivotally attached by a plurality of hinges 42 to a fixed strut 43 (see FIG. 2) that spans the rectangular frame 60. One skilled in the art should appreciate that a middle padded section can be included between the two articulated padded sections 44, 46 to introduce a space there between if so desired. In this case two separate hinges would be required, one for each pivotally-coupled padded section 44, 46. In addition, the frame 60 may be other than rectangular, for instance, with rounded corners, without departing from the scope and spirit of the invention.

In addition, two folding/pivoting support leg assemblies 70, 80 are pivot downward from the frame 60. A handle 22 (see FIG. 2) is fixedly attached centrally on one side of frame 60 to assist in carrying/transporting the bench 20 in its fully collapsed/folded configuration.

The rectangular frame 60 is preferably a fixed assembly of rectangular steel or aluminum tube that is cut into two side members 61 and two end members 62, which are then mitred and welded to form the rectangular frame 60.

The strut 43 is fixedly attached across frame 60 toward one end thereof The two padded sections include a longer rear padded section 44 and shorter front support section 46, both of which are pivotally attached to the strut 43 by conventional hinges 42. As seen in FIG. 1, the rear padded section 44 pivots upward and may be locked into a number of discrete user-selectable positions beginning at 90 degrees inclined to 0 degrees horizontal. The front padded section 46 likewise pivots upward and may be locked into one of two discrete positions including 30 degrees inclined or 0 degrees horizontal.

As best seen in FIG. 2, rear padded section 44 is supported in higher inclined positions either by a length-adjustable (telescoping) I-shaped brace assembly 30 that folds out of the frame 60 or, alternatively, in a low inclined position by a U-shaped support assembly 25 that likewise folds out of the frame 60.

Figure 3:
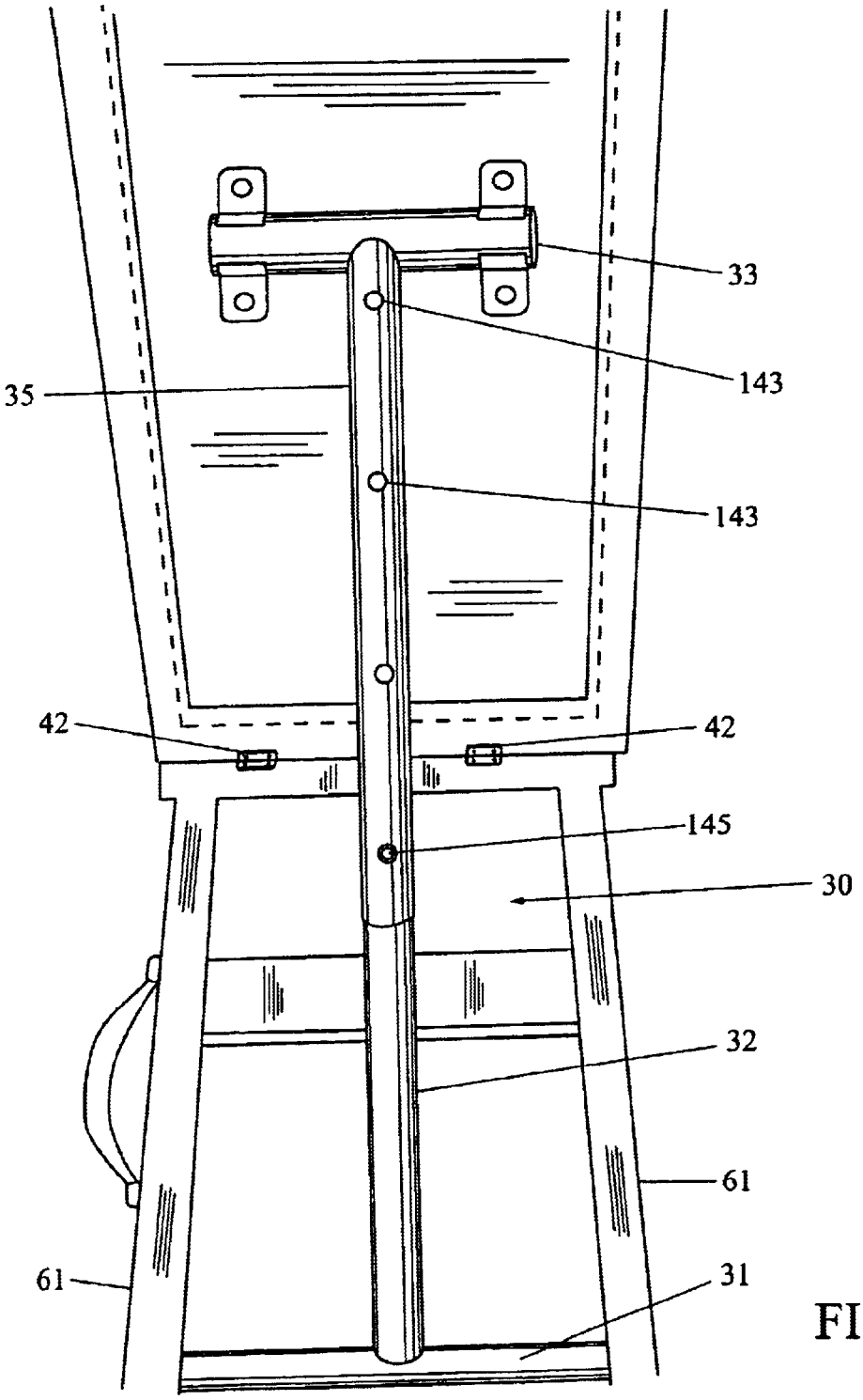
FIG. 3 is a close-up view of the length-adjustable (telescoping) I-shaped brace assembly 30 of FIG. 2.

FIG. 3 is a close-up view of the length-adjustable (telescoping) I-shaped brace assembly 30 of FIG. 2. With combined reference to FIGS. 2 and 3, the I-shaped brace assembly comprises an upper T-shaped section of tubing that can be adjustably attached along the length of rear padded section 44, and a lower T-shaped section of tubing that is pivoted at the frame 60. The lower T-shaped section of tubing includes a pivoting member 31 and a lower extension member 32. The upper T-shaped section of tubing includes a crossbar 33 and an upper extension member 35. The upper extension member 35 has a slightly larger diameter than the lower extension member 32 and the two are adapted for a telescoping fit. In addition, the upper extension member 35 is defined by a series of indexing holes 143, and a snap button 145 is loaded into the lower extension member 32 to cooperate with the indexing holes 143, thereby making up the entire length-adjustable (telescoping) I-shaped brace assembly 30 as seen fully in FIG. 3. The foregoing T-shaped sections may be integrally formed from welded tube-steel or aluminum.

Figure 4:
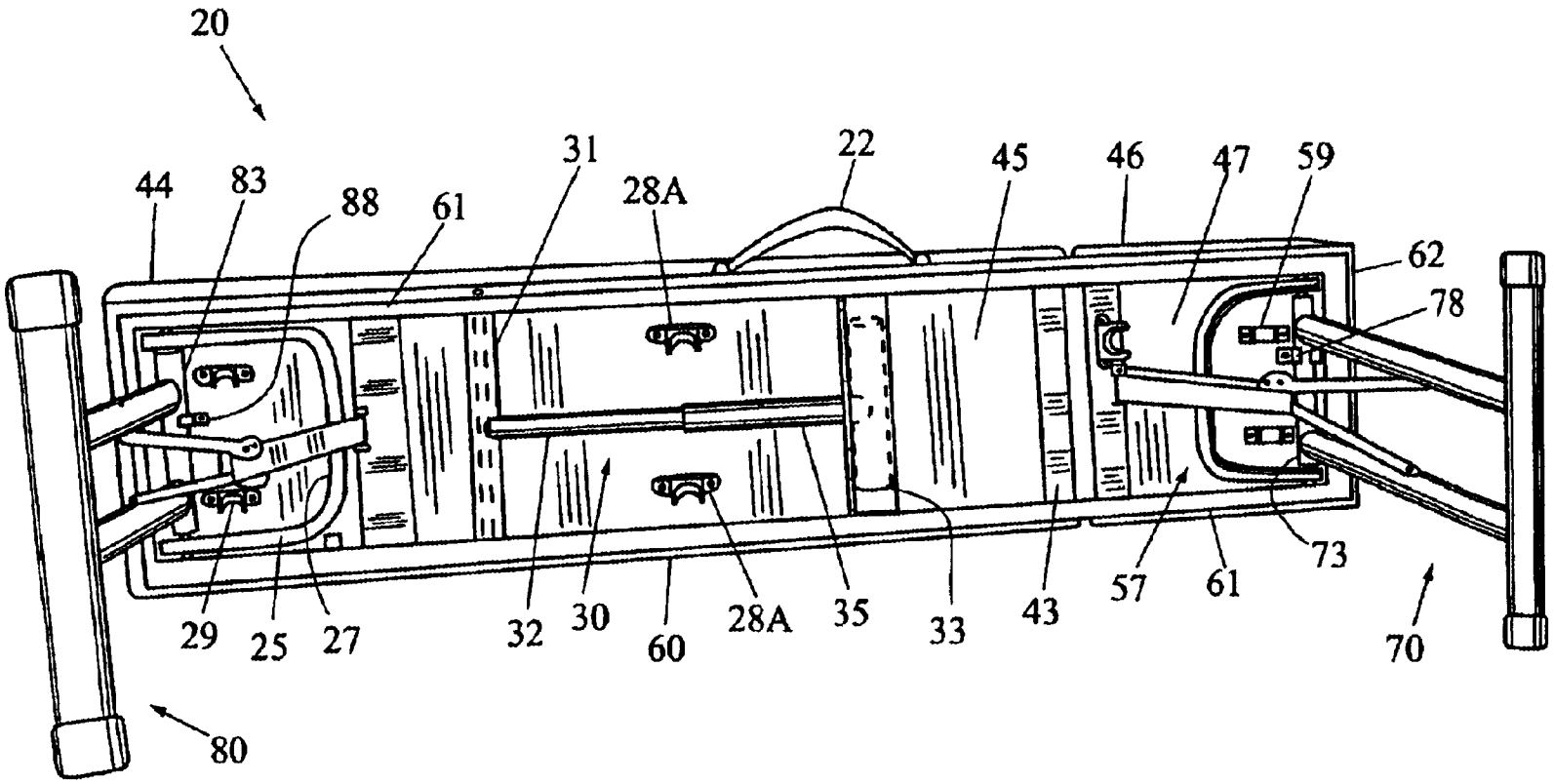
FIG. 4 is a bottom perspective view of the articulated bench 20 as in FIGS. 1 and 2.

FIG. 4 is a bottom perspective view of the articulated bench 20 as in FIGS. 1 and 2. The pivoting member 31 of I-shaped brace assembly 30 rotates around an axle mounted between the frame's side members 61.

Referring back to FIG. 2, rear padded section 44 is supported in a low inclined position by a U-shaped support assembly 25 fabricated of tube steel or aluminum. The U-shaped support assembly 25 pivots around an axle 26 mounted between the frame's side members 61 (Note: as discussed below, the rear leg assembly 80 also pivots around this same axle 26).

The crossbar 33 of the length-adjustable (telescoping) I-shaped brace assembly 30 may be inserted and locked into place in any one of a series of catches 28*a*, 28*b* located alongside the back of the respective padded section's 44. Specifically, catches 28*a* and 28*b* hold section 44 at either of two selectable inclines.

If a low incline of about 10 degrees is preferred, the crossbar 33 is collapsed completely and stowed inside the frame 60, and the cross-piece 27 of the U-support assembly 25 may be inserted and locked into place in a smaller pair of catches 29, located higher alongside the back of the rear padded section 44. Catches 29 hold section 44 at a fixed incline of about 10 degrees.

As best seen in FIG. 1, the shorter front padded section 46 is likewise supported in an inclined position by a U-shaped support assembly 55 that folds out of the front of frame 60. The front support assembly 55 pivots around an axle 56 mounted between the frame's side members 61 (as discussed below, the front leg assembly 70 also pivots around axle 56). The cross-piece 57 of the front support assembly 55 is inserted into a pair of catches 58 located on the padded section's rear surface 47 to hold the section 46 at a selectable incline. The front support assembly 55 is preferably fabricated of commercially available tubular steel or aluminum.

As best seen in FIG. 4, another catch 78, fixedly attached near the end of the padded section 46, removably attaches to the top crossbar 73 of the front leg assembly 70, to hold the section 46 against the frame 60, when no angle of inclination is required or when the bench 20 is being carried via the handle 22. Likewise, a similar catch 88 is fixedly attached near the end of the rear padded section 44. Catch 88 removably attaches the top crossbar 83 of the rear leg assembly 80 to lock the rear padded section 44 against the frame 60 when no angle of inclination is required or when the bench is being carried by handle 22.

All catches 28*a–b*, 29, 58, 78 and 88 are preferably resilient yokes fabricated of a semi-rigid plastic wherein the distal ends of the yoke must be forced apart slightly to seat and hold the respective crossbars 33, 73, 83 or cross-pieces 27, 57 there between.

Figure 5:
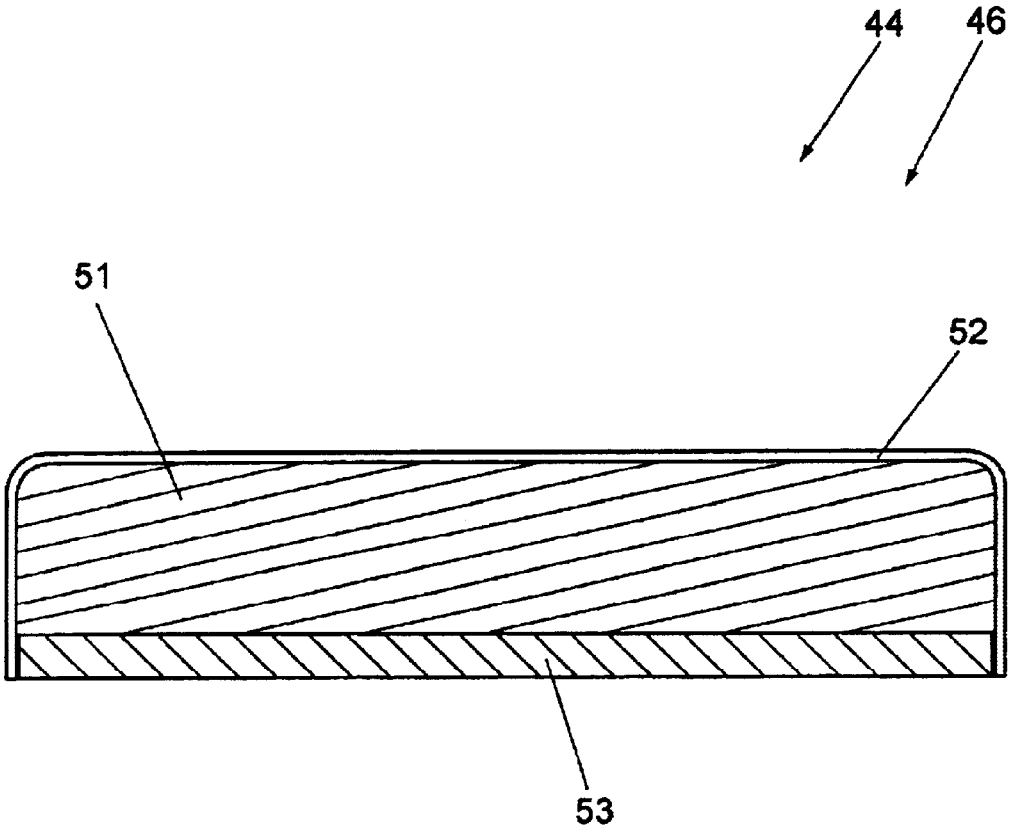
FIG. 5 is a cross-sectional view of padded section 42, 44, or 46.

FIG. 5 is a cross-sectional view that is representative of any of the padded sections 44, 46. Both of the padded sections 44, 46 include a layer of padding 51 with a pliable covering 52 fixedly attached to a support board 53. The layer of padding 51 may be of any thickness and any commercially available material that provides a suitable degree of cushioning when the weight of a body is applied. The pliable covering 52 is typically a commercially available plastic sheet material such as vinyl. The support board 53 is preferably a commercially available, rigid plastic, wood or composite material.

Figure 6:
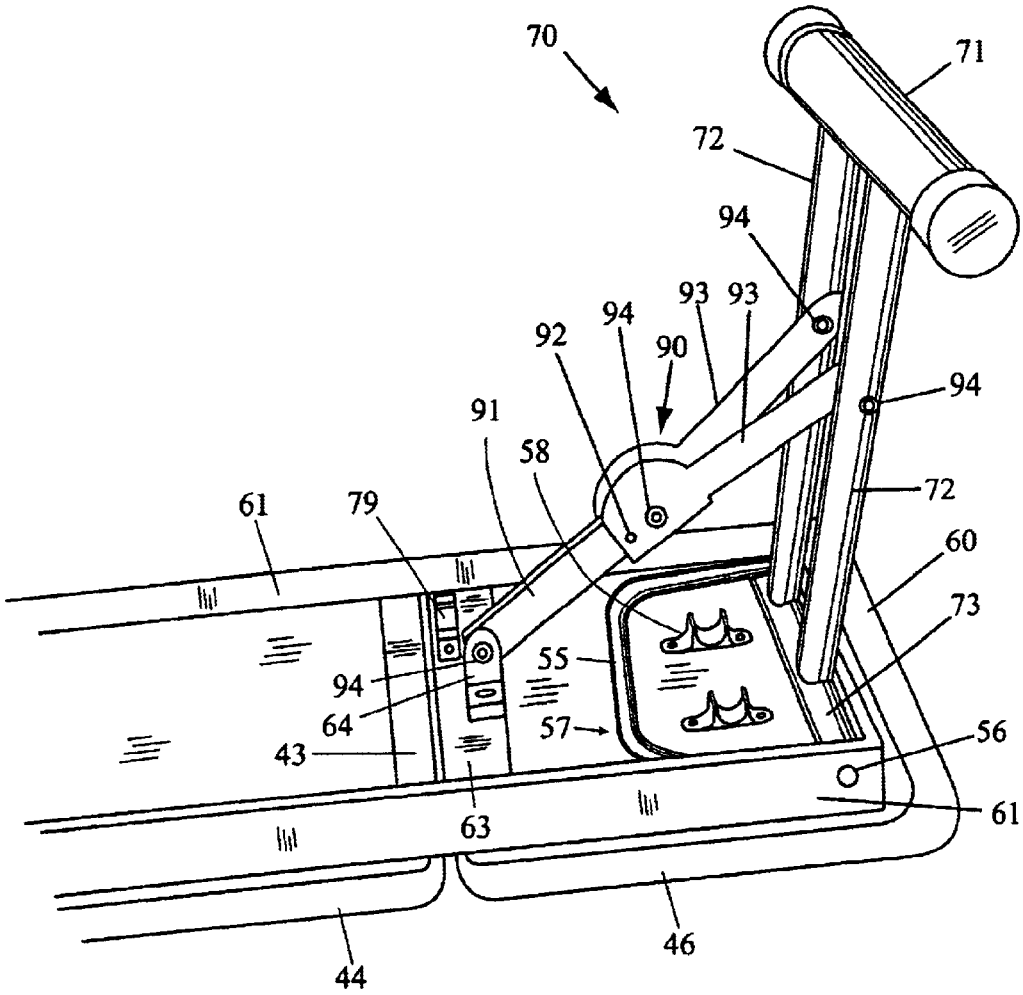
FIG. 6 is a close up view of the front leg assembly 70 according to a first embodiment of the present invention.
Figure 7:
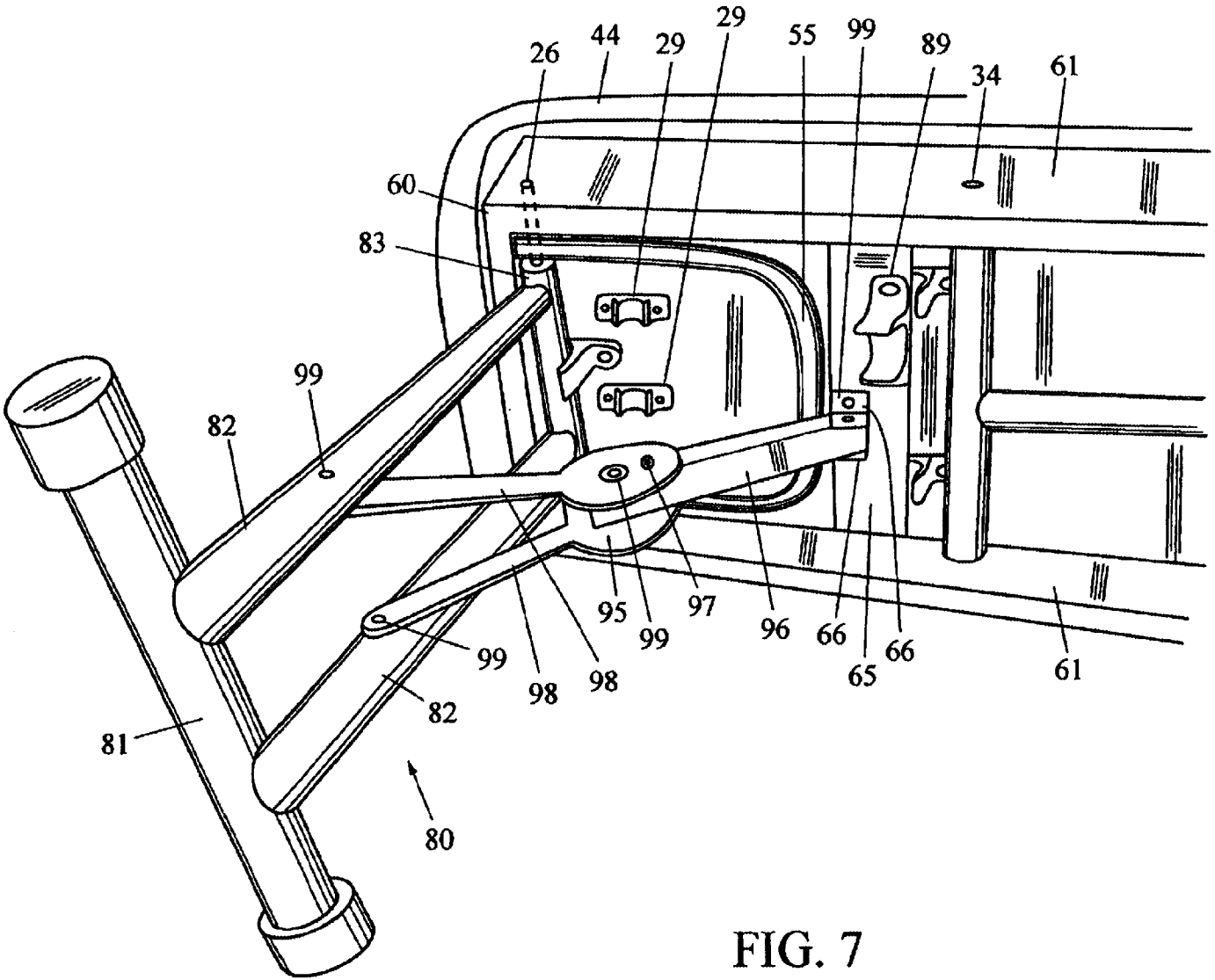
FIG. 7 is a close up view of the rear leg assembly 80 according to a first embodiment of the present invention.

FIGS. 6 and 7 are, respectively, close up views of the front leg assembly 70 and the rear leg assembly 80 according to a first embodiment of the present invention.

The front leg assembly 70 is pivotally mounted at the end of the rectangular frame 60 located beneath the front padded section 46. The leg assembly 70 includes a foot crossbar 71, two central members 72, a top crossbar 73, a catch 79, and a locking folding brace assembly 90. The foot crossbar 71, two central members 72, and top crossbar 73 are preferably fabricated of commercially available, rigid tubular steel or aluminum. The catch 79 is preferably a molded resilient yoke fabricated of a semi-rigid plastic wherein the distal ends must be forced apart slightly to seat and hold one of the central members 72 there between. The locking folding brace assembly 90 includes a frame cross member 63, two mounting brackets 64, an upper strut 91, a commercially available detent (or "snap") button 92, a lower strut 93, and four commercially available pivot pins 94. The cross member 63, two mounting brackets 64, upper strut 91, and lower strut 93 are preferably fabricated of commercially available formed aluminum or like material.

The front leg assembly 70 is constructed as follows. The central members 72 are fixedly attached perpendicularly at points along both the foot crossbar 71 and the top crossbar 73. The top crossbar 73 rotates around an axle 56 mounted between the frame's side members 61. The mounting brackets 64 are fixedly attached to cross member 63 and pivotally attached to one end of upper strut 91 via pivot pin 94. The other end of upper strut 91 is pivotally to the lower strut 93 via a second pivot pin 94. The other ends of the lower strut 93 are pivotally attached to the central members 72 via two additional pivot pins 94.

The catch 79, fixedly attached to cross member 63, removably attaches to one of the central members 72 of the front leg assembly 70, to hold the assembly 70 against the frame 60 in the collapsed/folded configuration (e.g. when the bench 20 is being carried via the handle 22).

With reference to FIG. 7, a rear leg assembly 80 is pivotally mounted at the end of the rectangular frame 60 located beneath the rear padded section 44. The leg assembly 80 includes a foot crossbar 81, two central members 82, a top crossbar 83, a catch 89, and a locking folding brace assembly 95. The foot crossbar 81, two central members 82, and top crossbar 83 are preferably fabricated of commercially available tubular steel or aluminum materials. The catch 89 is preferably a resilient yoke fabricated of a semi-rigid plastic wherein the distal ends must be forced apart slightly to seat and hold one of the central members 82 there between. The locking folding brace assembly 95 includes a frame cross member 65, two mounting brackets 66, an upper strut 96, a commercially available snap button 97, one lower strut 98, and four commercially available pivot pins 99. The cross member 65, mounting brackets 66, upper strut 96, and lower strut 98 are preferably fabricated of commercially available, formed aluminum or like material.

The rear leg assembly 80 is constructed as follows. The central members 82 are fixedly attached perpendicularly at points along both the foot crossbar 81 and the top crossbar 83. The top crossbar 83 rotates around an axle 26 mounted between the frame's side members 61. The brackets 66 are fixedly attached to cross member 65 and pivotally attached to one end of upper strut 96 via pivot pin 99. The other end of upper strut 96 is pivotally attached to the lower strut 98 via a second pivot pin 99. The other ends of the lower strut 98 are pivotally attached to the central members 82 via two additional pivot pins 99.

The catch 89, fixedly attached to cross member 65, removably attaches to one of the central members 82 of the rear leg assembly 80, to hold the assembly 80 against the frame 60 in the collapsed/folded configuration (e.g. when the bench 20 is being carried via the handle 22).

The support leg assemblies 70, 80 fold inward (i.e. toward the frame 60) for storing or transporting the bench 20. Upon folding outward, locking folding brace assemblies 90, 95 hold the leg assemblies 70, 80 in position substantially perpendicular to the frame 60. The leg assemblies 70, 80 pivot about axles 56, 26, respectively, that are common to the U-shaped support assemblies 55, 25.

In accordance with the unique design of the present invention, setup can be accomplished quickly and easily with one hand, the bench 20 still in the other hand (carried by the handle). With reference to FIGS. 1–4 and 6–7, the set up process for the articulated bench 20, from its fully collapsed configuration for storage or transportation, begins with the extension of the leg assemblies 70, 80. The front leg assembly 70 is extended by grasping the foot crossbar 71 and pulling. As the foot crossbar 71 moves away from the frame 60, after disengaging the central member 72 from the catch 79, the top crossbar 73 rotates around the axle 56, and the upper strut 91 and the lower members 93 rotate around the various pivot pins 94 to substantially straighten the locking folding brace assembly 90. Once the central members 72 reach a position that is substantially perpendicular to the frame 60, the folding brace assembly 90 is fully straightened and locked in place by the snap button 92 engaging a hole in lower strut 93.

The rear leg assembly 80 is then similarly extended by grasping the foot crossbar 81 and pulling. As the foot crossbar 81 moves away from the frame 60 (after disengaging the central member 82 from the catch 89), the top crossbar 83 rotates around the axle 26, and the upper strut 96 and the lower strut 98 rotate around the various pivot pins 99 to substantially straighten the locking folding brace assembly 95. Once the central members 82 reach a position that is substantially perpendicular to the frame 60, the folding brace assembly 95 is fully straightened and locked in place by snap button 97 engaging a hole in lower strut 98.

Once both leg assemblies 70, 80 have been extended and locked in place, the bench 20 can be turned over and set upon the ground or floor (i.e. resting in a stable configuration on foot crossbars 71, 81). Alternatively, the front leg assembly 70 can be left in its folded position with rear leg assembly 80 extended to configure the bench 20 as an inclined bench, thereby making it more suitable for certain exercises and/or tastes.

To set the angle of inclination of the front padded section 46, the catch 78 attached to its rear surface 47 must first be disengaged from top crossbar 73 by pulling on the distal end of the section 46. This will allow the section 46 to pivot via hinges 42 as its distal end is moved away from the frame 60. Once the section 46 has been raised sufficiently, the U-shaped support assembly 55 is grasped and pulled away from frame 60. This causes the support assembly 55 to rotate around the axle 56. The cross-piece 57 of the support assembly 55 is then engaged with catches 58 which are attached to the section's rear surface 47, thereby locking the padded section 46 at an angle of inclination. The angle of inclination can be returned back to horizontal by disengaging the cross-piece 57 from catch 58, and pivoting the padded section 46 and support assembly 55 all the way down.

To set the angle of inclination of the rear padded section 44, the catch 88 attached to its rear surface 45 must first be disengaged from top crossbar 83 by pulling on the distal end of the section 44. This will allow the section 44 to pivot via hinges 42 as its distal end is moved away from the frame 60. Once the section 44 has been raised sufficiently, the crossbar 33 of the I-shaped brace assembly 30 is grasped and pulled away from frame 60. This causes the beam assembly 30 to rotate around the axle 34. The crossbar 33 is then engaged with either of two pair of catches 28*a*, 28*b* attached to the section's rear surface 45 to lock the padded section 44 at the desired incremental angle of inclination. In between incremental adjustments, the length-adjustable (telescoping) I-shaped brace assembly 30 may be extended and/or contracted as desired to afford a continuous spectrum of intermediate inclination adjustments. For an extremely low angle of inclination, U-shaped support 25 may be rotated about axle 26 and cross-piece 27 may be engaged with catches 29.

To fold the articulated bench 20 into its fully collapsed configuration for storage or transportation, once the front and rear padded sections 46, 44, respectively, have been locked in position next to frame 60 by engaging the catches 78, 88 with the corresponding top crossbars 73, 83, the front leg assembly 70 is collapsed by depressing the snap button 92 to unlock folding brace assembly 90. Again, all of this can be accomplished with one hand while the bench 20 is carried in the other. The foot crossbar 71 is then pushed toward the frame 60. This causes the top crossbar 73 to rotate around the axle 56, and the upper strut 91 and the lower members 93 to rotate around the various pivot pins 94 to collapse the locking folding brace assembly 90. Once the central members 72 reach a position that is substantially parallel to the frame 60, and the folding brace assembly 90 is fully collapsed, one of the central members 72 is engaged with catch 79 to hold the collapsed leg assembly 70 in place.

The rear leg assembly 80 is then similarly collapsed by depressing the snap button 97 to unlock folding brace assembly 95 in a direction toward the frame 60 to unlock it. The foot crossbar 81 is then pushed toward the frame 60. This causes the top crossbar 83 to rotate around the axle 26, and the upper strut 96 and the lower strut 98 to rotate around the various pivot pins 99 to collapse the locking folding brace assembly 95. Once the central members 82 reach a position that is substantially parallel to the frame 60, and the folding brace assembly 95 is fully collapsed, one of the central members 82 is engaged with catch 89 to hold the collapsed leg assembly 80 in place.

"Referring back to FIG. 2, an optional hand brace 180 is also shown. The hand brace 180 comprises a substantially U-shaped bar of tubular construction with detent pins 181 at each end. The hand brace 180 can be slidably inserted into yoke receptacles 182 secured to the end 62 of frame 60 and locked into upright position by detent pins 181, thereby providing a hand-hold to support the upper body during abdominal and/or leg exercises."

As is readily perceived in the foregoing description, the present invention's design is simple, lightweight and straightforward, and can be economically manufactured. Its combination of flexibility, structural strength and ease of setup allows for a myriad of uses in athletics and/or therapeutics, including weight training exercises and other activities requiring the body to be supported in a non-vertical position. The collapsible nature of its design provides for easy storage and transportation of the articulated bench.

Having now fully set forth the preferred embodiment and certain modifications of the concept underlying the present invention, various other embodiments as well as certain variations and modifications of the embodiments herein shown and described will obviously occur to those skilled in the art upon becoming familiar with said underlying concept. It is to be understood, therefore, that the invention may be practiced otherwise than as specifically set forth in the appended claims.

I claim:

1. An articulated bench, comprising:

an elongate frame;

a first padded section pivotally attached to said frame at a first pivot point for upward inclination, said first padded section having a plurality of open-yoke catches spaced lengthwise along an underside;

a second padded section pivotally attached to said frame at said first pivot point behind said first padded section for upward inclination; and a first leg assembly pivotally attached at a second pivot point to one end of said frame for downward extension and load-bearing contact against a support surface; and a second leg assembly pivotally attached at a third pivot point to an opposing end of said frame for downward extension and load-bearing contact against said support surface; and a length-adjustable telescoping beam pivotally attached at one end to said frame at a fourth pivot point, said telescoping beam having a cross-piece at an opposing end that is pivotable upward for insertion into at least one of the open-yoke catches along said first padded section for releasably locking said first padded section at a one of a series of selectable inclines, and the length of said telescoping beam may be adjusted to further adjust the incline of said first padded section.

2. The articulated bench according to claim 1 wherein said telescoping beam is a telescoping I-shaped brace assembly.

3. The articulated bench according to claim 1, further comprising a U-shaped brace assembly pivotally mounted at one end of said frame for supporting said second padded section in an inclined position.

4. The articulated bench according to claim 3 wherein one of said two leg assemblies and said U-shaped brace assembly are rotatably connected to a common axle.

5. An articulated bench, comprising:

a frame;

a first padded section atop said frame and pivotally attached to said frame for upward inclination;

a second padded section atop said frame and pivotally attached to said frame behind said first padded section for upward inclination; and a first leg assembly pivotally attached to said frame at one end thereof for downward extension beneath said frame for load-bearing contact against a support surface; and a second leg assembly pivotally attached to said frame at another end thereof for downward extension beneath said frame for load-bearing contact against said support surface;

a U-shaped brace assembly for supporting at least one of said padded sections in a selectable inclined position, and a common axle pivotally connecting one of said first and second leg assemblies and said U-shaped brace assembly to said frame.

6. The articulated bench according to claim 5 wherein at least one of said padded sections is supported in a selectable inclined position by a telescoping I-shaped brace assembly.

7. The articulated bench according to claim 5, further comprising a substantially U-shaped hand brace and a pair of yoke receptacles mounted on said frame at one end thereof, said hand brace being selectively inserted into said receptacles to provide a hand-hold to support the upper body.

8. The articulated bench according to claim 1, further comprising a substantially U-shaped hand brace and a pair of yoke receptacles mounted on said frame at one end thereof, said hand brace being selectively inserted into said receptacles to provide a hand-hold to support the upper body.

* * * * *